United States Patent [19]

Suzuki et al.

[11] Patent Number: 4,888,218

[45] Date of Patent: Dec. 19, 1989

[54] PROCESS FOR APPLYING A ZINC COATING TO AN ALUMINUM ARTICLE

[75] Inventors: Masamichi Suzuki, Michima; Tadaaki Sano, Fuji; Toshihiro Suzuki, Numazu; Tsunehiko Tanaka, Fuji, all of Japan

[73] Assignee: Alcan International Limited, Montreal, Canada

[21] Appl. No.: 133,265

[22] Filed: Dec. 16, 1987

Related U.S. Application Data

[63] Continuation of Ser. No. 831,043, Feb. 12, 1986, abandoned, which is a continuation of Ser. No. 608,141, May 8, 1984, abandoned.

[30] Foreign Application Priority Data

May 9, 1983 [JP] Japan ..... 58-80527

[51] Int. Cl.[4] ..... C23C 10/00

[52] U.S. Cl. ..... 427/383.9; 427/436

[58] Field of Search ..... 427/383.9, 436

[56] References Cited

U.S. PATENT DOCUMENTS 2,297,241 9/1942 Perner ..... 427/436

*Primary Examiner*—Sam Silverberg

*Attorney, Agent, or Firm*—Cooper & Dunham

[57] ABSTRACT

A process for coating an aluminum article with zinc by immersing the article in an aqueous bath prepared by dissolving solid zinc fluoride in water. Preferably, the pH of the bath is about 4 to about 6. After coating, the article can be heated to diffuse zinc into surface-adjacent regions of the article and thereby to provide a zinc-diffused layer that protects the article against corrosion.

4 Claims, No Drawings

PROCESS FOR APPLYING A ZINC COATING TO AN ALUMINUM ARTICLE

This is a continuation of application Ser. No. 831,043, filed Feb.12, 1986, abandoned, which is a continuation of application Ser. No. 608,141 filed May 8, 1984 (now abandoned).

BACKGROUND OF THE INVENTION

This invention relates to the treatment of aluminum articles to protect them against corrosion. In a particular sense, it is directed to a process for applying a coating of zinc on surfaces of an aluminum article, such coating being suitable for forming a zincdiffused surface layer to protect the article against corrosion. The term "aluminum" as used herein refers to aluminum metal and alloys thereof.

It is already known to protect an aluminum article against corrosion by depositing a coating of zinc on surfaces of the aluminum article, as by a so-called zincating treatment, and then heating the article to a temperature at which the zinc diffuses into the coated surfaces and surface-adjacent regions of the article. The depth to which the zinc diffuses and the concentration of zinc in the diffused surface layer of the aluminum article are dependent to a considerable extent on the amount of zinc deposited. Since the zinc acts as a sacrificial anode for the protection of the aluminum, the effectiveness of the corrosion protection provided by the zinc (including the length of time such protection is effective) is to a considerable extent dependent both on the thickness of the zinc-diffused surface layer and the concentration of Zn in such layer.

In order to achieve satisfactory protection, it is necessary that the aluminum surfaces be protected all over and that the Zn-diffused layer should be free from localized areas in which diffused Zn is absent or present only in insufficient quantity. It is therefore important that the initially deposited zinc should be firmly attached to the underlying aluminum and free from localized blemishes.

In a conventional zincating treatment in a bath containing 300–500 g/1 NaOH and 50–100 g/1 dissolved ZnO at a temperature of 20°–30° C., the amount of zinc deposited is normally about 1.0 g/m$^2$, although this is dependent upon the duration of the immersion in the bath and the conditions of the pretreatment of the aluminum surface before dipping.

In tests, in which the temperature of the bath was raised to 40°–60° C. to increase the rate of zinc deposition, abnormal deposition appeared; that is, zinc deposited locally with irregular thickness and moreover bonding was very poor and the zinc layer was not suitable for zinc diffusion treatment. On the other hand, when the bath temperature was lowered to 20°–30° C. to suppress abnormal deposition, zinc initially deposited rapidly but then the rate of deposition greatly decreased and more than 20 minutes was required to deposit zinc to the fullest extent of about 10–15 g/m$^2$. Further, it was very difficult to reproduce the results and therefore the method was considered unsuitable for industrial use.

The problems resulting from slow deposition at temperatures normally employed in a single stage zincating treatment can, however, be alleviated to a considerable extent by employing the two-stage zincating treatment described in the copending U.S. patent application of Masamichi Suzuki (one of the applicants herein), Atsushi Sugihara, Tadaaki Sano (one of the applicants herein), and Toshihiro Suzuki (one of the applicants herein), Ser. No. 06/491,022, filed May 3, 1983, for "Process for Coating Aluminum with Zinc," and assigned to the same assignee as the present application.

On the other hand, that two-stage process does not overcome other problems encountered in the industrial application of any zincating process, which depends upon the use of a zincating bath having a high concentration of sodium hydroxide. Because of its high NaOH content, for example 350 g/l, the known bath is relatively viscous and is therefore difficult to employ successfully in the treatment of articles or assemblies of complicated form, particularly where there are narrow recesses, such as may occur, for example, in evaporators, condensers, and automobile heat exchangers constituted of flattened tubes and fins. If an attempt is made to treat these articles in the known zincate baths mentioned above, the viscous zincate bath liquor does not penetrate rapidly or even completely into all the recesses,with the result that the deposition of zinc at such localities may be incomplete or, at worst, nonexistent. This will be readily understood by considering an assembly made up of flattened tubes in serpentine form with corrugated fins fixed to them by pinching.

In addition to the problem of possibly inadequate penetration into recesses and consequently inadequate deposition of zinc, problems also arise in removing excess bath liquor from the treated assembly. Because of the high viscosity of the zincate bath liquor, it drains poorly from the surface of the treated assembly and, particularly, it tends to be retained within recesses. Consequently, there is not only a high loss of the dissolved solids content of the bath, carried over with the dipped assemblies, but also large quantities of water are required to wash off these residues from the assemblies. Since the wash water contains dissolved sodium hydroxide, costly waste water treatment equipment must be employed before the wash water can be discharged to waste.

It would be desirable to overcome the foregoing disadvantages, and, in particular, to achieve a rapid and uniform deposition of an adherent zinc layer on surfaces of an aluminum article by dipping in an aqueous bath having a low content of dissolved solids and consequently low viscosity.

SUMMARY OF THE INVENTION

The present invention broadly contemplates the provision of a process for applying a zinc coating to surfaces of an aluminum article, comprising the steps of dissolving solid zinc fluoride in water for establishing an aqueous bath containing dissolved zinc fluoride, and immersing the article in the bath for a time sufficient to deposit zinc in an amount of about 2 to about 20 g/m$^2$ on the article surfaces. It is found that by this treatment, zinc can be deposited uniformly in the stated amount of about 2 to about 20 g/m$^2$, more preferably in an amount of about 3 to about 15 g/m$^2$, with excellent bonding of the zinc, providing a coating eminently suitable for subsequent diffusion to achieve a zinc-diffused layer as desired for protecting the treated article against corrosion.

As used herein, the term "zinc fluoride" embraces anhydrous zinc fluoride ($ZnF_2$) and zinc fluoride tetrahydrate ($ZnF_2 \cdot 4H_2O$), both of which have low solubility in water. All values of amounts and concentrations of zinc fluoride given herein will be expressed as amounts and concentrations of the tetrahydrate, $ZnF_2 \cdot 4H_2O$.

The solubility of zinc fluoride in water is so low that a saturated solution has a viscosity little different from that of water. Consequently, a saturated solution of zinc fluoride penetrates easily into recesses of an article being treated, and drains easily after dipping with very little removal of dissolved solids from the treatment bath so as to require only relatively small amounts of wash water.

In the practice of the present process, the article to be treated is ordinarily subjected to a preliminary degreasing and/or other surface-cleaning treatment, e.g. of conventional character, before being immersed in the zinc fluoride bath. The bath, prepared by adding solid particulate zinc fluoride to water, is preferably maintained at a pH of about 4 to about 6. In some instances it is desirable to provide a small quantity of undissolved zinc fluoride in the bath, preferably in suspension, so that the bath is maintained in essentially saturated condition. The quantity of undissolved fluoride preferably is such that it does not adversely affect the viscosity of the bath and, for that purpose, the undissolved zinc fluoride content of the bath is preferably kept within the range of 5–120 g/1.

After completion of zinc deposition in the immersing step, the treated aluminum article is lifted out of the bath and dried. It is usually preferred to rinse the article before drying.

In a complete procedure for protecting an aluminum article against corrosion, incorporating the foregoing zinc-coating process, a zinc-diffused surface layer may be produced by directly heating the coated aluminum article. Alternatively, the zinc-diffused surface layer can be produced in the course of a furnace-brazing operation in which the aluminum article is subjected to a temperature close to its melting point.

It is particularly because of the handling that the treated article may undergo between the zinc deposition treatment and such a final brazing treatment that a good bond of the deposited zinc is required.

By the use of the zinc deposition process of the present invention, it is found possible to achieve a zinc-diffused layer containing 0.5–7% zinc and having a diffusion depth of 50–150 microns. It is found that this can effectively resist pitting or other corrosion for long periods, even in rigorous operating conditions to which motor vehicles may be subjected.

Further features and advantages of the invention will be apparent from the detailed description hereinbelow set forth.

DETAILED DESCRIPTION

In the process of the invention, degreasing or other preliminary treatment (of an aluminum article to be coated with zinc) may be carried out in a conventional manner before the article is dipped in a zinc fluoride bath to deposit zinc. The aluminum article to be treated may be in the form of sheet, plate, extruded section or preformed shape, such as a pressing. The process of the invention is applicable to articles fabricated of a wide range of aluminum alloys and commercial purity aluminum, such as (by way of example, referring to Aluminum Association registered designations) commercial purity aluminum grades AA 1100, AA 1050, and AA 1099; Al-Cu alloys AA 2014, AA 2017, and AA 2024; Al-Mn alloys AA 3003 and AA 3004; Al-Si alloys AA 4043, AA 4045, and AA 4343; Al-Mg alloys AA 5052 and AA 5056; Al-Mg-Si alloys AA 6061 and AA 6063; and Al-Zn-Mg alloys of the AA 7000 series. Relatively little natural oxide film is generated on an article fabricated of any of these materials unless a long time has passed since its manufacture. Therefore, the zinc deposition reaction can be carried out with good reproduceability because oil contamination, aluminum powder or other stains adhering to surfaces of the article to be treated can be effectively removed by using an appropriate organic solvent, such as trichloroethylene, perchloroethylene, trichloroethane, or Freon 113 prior to immersion of the article in the zinc fluoride bath. However, if a natural oxide film has already grown to such a degree that its presence inhibits the reaction between aluminum and zinc fluoride, the material may be degreased or etched by caustic alkali, e.g. NaOH solution. In the case of the NaOH +ZnO zincate bath of the prior art, there was a problem that, if the aluminum was pretreated with NaOH solution, zinc could not be deposited with good reproduceability. It is an advantage that the use of the zinc fluoride bath of the present invention is not adversely affected by pretreatment of the aluminum in sodium hydroxide.

In at least many instances, however, it is currently preferred to use as the surface cleaning or pretreating medium a solution of a non-etching type cleaner, e.g. sodium metasilicate ($Na_2SiO_3 \cdot 9H_2O$) in aqueous solution, a specific example of such pretreatment being immersion of the aluminum article to be treated in a 50 g/1 solution of sodium metasilicate at 50° C. for three minutes. An etching type (e.g. alkali) solution is preferably used in cases where the level of subsequent zinc deposition is to be relatively low ($5 \pm 2$ g/m$^2$). Particular conditions sometimes govern the selection of a particular pretreatment; thus, where previously welded parts are to be zinc coated, pretreatment with a non-etching type cleaner such as sodium metasilicate is strongly preferred over treatment with trichloroethylene, to overcome the hand staining (surface contamination resulting from handling incident to welding) which otherwise inhibits zinc deposition from the acidic zinc fluoride bath.

The coating process of the invention, as applied to an aluminum article which has typically been degreased or precleaned as just described, includes the steps of preparing an aqueous bath containing dissolved zinc fluoride by adding solid particulate zinc fluoride to water, and immersing the article in the bath for depositing zinc on the article surfaces.

Referring first to the bath-preparing step, solid zinc fluoride suitable therefor is available as an anhydride or as a tetrahydrate. Both forms have very low solubility in water; even the tetrahydrate has a solubility of only about 27.5 g/1 at 20° C. (16.2 g/1 expressed as grams of $ZnF_2$ per liter of water). In the present invention, the low solubility of zinc fluoride is advantageous. For use in the present process, zinc fluoride is preferably formed as grains in a size range of 1–100 microns.

In embodiments of the process wherein the aqueous bath contains excess, undissolved zinc fluoride, the undissolved particles are preferably kept in suspension by agitating the solution slightly, and the undissolved solid content is preferably about 5–120 g/l, but is not limited to this amount. The undissolved solids content may be satisfactory as long as it does not affect adversely the uniformity of the deposition reaction and the adhesion of deposited zinc to the surface of aluminum. $Zn^{++}$ ion will then be supplemented as it is lost during the deposition reaction and zinc fluoride dissolved in the bath will then remain at or close to the saturated concentration at the bath temperature. However, if the volume of bath employed is sufficiently large in relation to the surface area of the aluminum article or articles under treatment, so that the drop of $Zn++$ concentration can be disregarded, it is unnecessary for undissolved zinc fluoride to be present in the bath.

Coating of the surfaces of an aluminum article with zinc in accordance with the invention is effected by immersing the article in an aqueous zinc fluoride bath as described above. When a pretreated aluminum article is dipped in an aqueous zinc fluoride bath, the rate of zinc deposition is mainly controlled by the bath temperature, and establishes a relationship between the amount of zinc deposition and deposition time. The pH of the bath is about 5.1 at 25° C. and 4.8 at 50° C. These pH values are widely different from those of the strong alkaline zincate baths of the prior art. With the zinc fluoride bath of the present invention, zinc is deposited in an amount of about 2 $g/m^2$ at bath temperature 20°-70° C. in 10-60 seconds. After this initial rapid deposition, zinc deposition increases in a substantially linear relationship to the treatment time. The amount of deposited zinc increases to 15-20 $g/m^2$ in 15-20 minutes at 20°-25° C. or in 15 minutes at 60°-70° C. When the amount of zinc deposition exceeds 20 $g/m^2$, problems sometimes appear with respect to either reproduceability, uniformity or strength of bonding. Therefore, the amount of zinc deposited in industrial use would preferably be held within the range of 2-15 $g/m^2$.

The pH of the bath is preferably held within the range of about 4-6. However, if acid or alkali is added to the bath, the change of pH may influence the amount and rate of zinc deposition.

After completion of zinc deposition, the zinc-coated aluminum article should be lifted from the bath and, if there is a large amount of undissolved zinc fluoride adhering thereto (i.e. in those instances where the bath contains undissolved zinc fluoride particles), the article should be rinsed in a zinc fluoride solution which does not contain undissolved solids. Thereafter, the zinc-diffused layer desired for protection against corrosion may be created by heating the zinc-coated article to the appropriate temperature for diffusion of zinc from a coating layer, such temperature being conventional and well-known in the art. Alternatively, the aluminum article may be coated with a known brazing flux and zinc may be diffused into the surfaces of the aluminum article in the course of brazing at 590°-610° C., without any preliminary process of diffusion.

Advantageously, the flux is a fluoride-type flux, e.g. a mixture mainly consisting of compounds of KF and $AlF_3$, $KAlF_4$ alone, or a mixture containing at least two kinds out of $KAlF_4$, $K_3AlF_6$, or $AlF_3$, as described in U.S. Pat. No. 3,951,328. Since both the source of the zinc coating and the flux are fluorides, the flux will not be contaminated with impurities. Thus, when the flux-coated aluminum article is dried and brazed, with the zinc-diffused layer being formed during the brazing operation, the effect of zinc diffusion treatment can be thoroughly exerted to provide corrosion resistivity after brazing.

According to the present invention, as described above, zinc can be deposited on the surfaces of aluminum articles stably and uniformly in amounts within the wide range of 2-15 $g/m^2$ by immersion in a zinc fluoride solution. Also, the thickness of the zinc-diffused layer and the zinc concentration in the surface layer may be 50-150 microns and 1-7%, respectively.

Finally, the low solubility of zinc fluoride in aqueous solution is advantageous in the present invention. Even with assemblies of aluminum members having complicated forms or narrow recesses, the zinc fluoride bath can very easily enter into or be drained from deep recesses because of the low viscosity of the solution. Accordingly, the overall process time involved can be effectively reduced as compared with the use of the strongly alkaline, viscous zincating baths of the prior art.

By way of further illustration of currently preferred practice of the process of the invention, a suitable range of proportions of zinc fluoride in the aqueous bath (including both zinc fluoride in solution and any excess undissolved zinc fluoride present) is broadly about 5 to about 150 g/1, preferably about 15 to about 100 g/1, and (for embodiments in which excess, undissolved zinc fluoride is in the bath) most preferably about 55 to about 70 g/1. In other instances, it is preferred to employ as the dipping bath an essentially saturated aqueous solution of zinc fluoride (i.e. a solution having a zinc fluoride content not more than about 10% below the saturating value), periodically replenished, but substantially or even entirely free of undissolved zinc fluoride. The range of bath temperature for the immersing step may be broadly about 20 to about 70° C., preferably about 25° to about 60° C., and most preferably about 30° to about 50° C. For deposit of $10\pm2$ $g/m^2$ zinc at a bath temperature of 30°-50° C., a range of immersion times is about 0.5 to about 10 minutes, preferably $3\pm0.5$ minutes. The pH of the bath is controlled between about 4 and about 6 by addition of HF as necessary.

Thus, for providing a $10\pm2$ $g/m^2$ zinc deposit on an aluminum article, it is currently preferred to operate with a bath containing 55-70 g/1 zinc fluoride and having an aluminum ($Al+++$) ion concentration of 2-3 g/1, at a bath temperature of $40\pm2$° C., with a pH of 4.6-4.8, and a dipping (immersing) time of $3\pm0.5$ minutes. Change in amount ($g/m^2$) of zinc deposited is conveniently effected by altering the bath temperature and/or dipping time. It is found that the level of aluminum ion should be controlled within limits (e.g. about 1-3 g/1, for deposit of $10\pm2$ $g/m^2$ of zinc from a bath containing 55-70 g/1 zinc fluoride) in order to achieve maintained satisfactory and uniform deposit of zinc. Since aluminum ion is produced in and builds up in the bath as treatment proceeds, especially over a period of time with the same bath used to coat a succession of aluminum articles, one way of effecting such control is by periodically replacing a portion of the bath with fresh zinc fluoride bath free of aluminum ions.

The present invention will be more completely explained by reference to the following examples.

EXAMPLE 1

An extruded, flat aluminum tube of 22 mm breadth, 5 mm height and 400 mm length (AA 1050 grade) was degreased with trichloroethylene vapor. It was then treated in a two-liter bath containing different quantities of zinc fluoride, which was added in the form of $ZnF_2 \cdot 4H_2O$ of 98% purity. The bath was stirred to maintain undissolved zinc fluoride in suspension. Where the zinc fluoride concentration was 25 g/1, it was completely dissolved. With higher concentrations, the bath became saturated. It is understood that the saturated solubility of zinc fluoride is about 27 g/l at 20° C. At 20° C. and zinc fluoride in amount of 35 g/l, there will be about 8 g/l undissolved zinc fluoride. The deposited layer of Zn was uniform in each case with excellent bonding and suitable for the formation of a zinc-diffused layer. The results are shown in Table 1.

Three pieces of the sample flat tube were taken and zinc-deposited in an aqueous bath of 15 g/l zinc fluoride at 50° C. for 1, 2 and 3 minutes to obtain zinc deposition of 3.9, 5.4 and 7.1 g/m$^2$, respectively. Then, the samples were heated at 600° C. for two minutes in $N_2$ atmosphere to diffuse the deposited zinc. As a result, the surface zinc concentrations and depths of the diffused layer of the three samples became respectively 2.5%, 86 microns; 3.2%, 105 microns, and 4.5%, 120 microns.

Then, the three flat tube samples were bent in U-form and thin fin sheets were bent into corrugated form and were assembled by the use of jigs and then treated for zinc deposition under the conditions of 25 g/l zinc fluoride at 50° C. and for 1, 2, 3 minutes (dipping times). Resultant zinc depositions were 3.9 g/m$^2$ after 1 minute, 5.8 g/m$^2$ after 2 minutes, and 7.9 g/m$^2$ after 3 minutes with good reproduceability. The samples were rinsed with clear zinc fluoride solution and dried and then coated with fluoride flux at the rate of 10 g/m$^2$ and brazed at 600° C. for 2 minutes. As a result, excellent brazing was obtained; the concentration of zinc and depth of zinc diffusion was 3.0% and 82 microns for the sample dipped 1 minute, 4.3% and 103 microns for the sample dipped 2 minutes, and 5.7% and 120 microns for the sample dipped 3 minutes.

The samples were thereafter tested for corrosion resistance by the so-called "Copper Accelerated Acetic Acid Salt Spray" (CASS) testing procedure (which corresponds to A.S.T.M. Standard B368). The maximum pitting corrosion depth in the CASS test was less than 0.1 mm (1300 hrs) for all the samples. The results were quite satisfactory.

TABLE 1

RELATIONSHIP OF DIPPING CONDITIONS VS. Zn DEPOSITION (Zn g/m$^2$)

| Concentration $ZnF_2.4H_2O$ (g/l) | Dipping time (min) | Dipping temperature (deg C.) 25 | 40 | 50 | 60 |
|---|---|---|---|---|---|
| 5 | 0.5 | — | — | — | 1.4 |
| | 1 | — | 0.6 | 1.3 | 1.8 |
| | 2 | — | — | 2.2 | 2.7 |
| | 3 | — | 1.8 | 2.7 | — |
| | 5 | 0.3 | 3.1 | — | — |
| 15 | 0.5 | — | — | — | 2.9 |
| | 1 | — | 3.0 | 3.9 | 4.0 |
| | 2 | — | — | 5.4 | 7.0 |
| | 3 | — | 4.8 | 7.1 | — |
| | 5 | 2.5 | 6.3 | — | — |
| 25 | 0.5 | — | — | — | 3.7 |
| | 1 | — | 3.4 | 3.7 | 5.7 |
| | 2 | — | — | 5.6 | 7.7 |
| | 3 | — | 4.6 | 8.0 | — |
| | 5 | 5.4 | 6.5 | — | — |
| 35 | 0.5 | — | — | 3.1 | 3.4 |
| | 1 | — | 3.0 | 3.5 | 4.4 |
| | 2 | — | — | 5.7 | 7.3 |
| | 3 | — | 4.4 | 7.3 | — |
| | 5 | 5.5 | 6.6 | 10.7 | — |

From the above Table 1, it can be seen that the rate of deposition of zinc is virtually independent of zinc fluoride concentration in the bath at and above 15 g/l except at relatively low temperatures.

On the other hand, the rate of zinc deposition at 5 g/l zinc fluoride is comparatively slow and the use of baths having a lower zinc fluoride concentration would be of little interest in an industrial application.

EXAMPLE 2

In this example, samples of tube of AA 1050, sheet of AA 1050 and brazing sheet comprising core material of AA 3003 alloy and both surface layers of AA 4045 alloy, were prepared. Then the effect of preliminary treatment was checked for each sample aluminum material in terms of zinc deposition. Comparing trichloroethylene vapor with NaOH (55° C., 0.5 min.) for treating the samples, it was found that zinc deposited in different amounts, depending on the material when cleaned in trichloroethylene, but there was no significant difference when pretreated in sodium hydroxide. The zinc deposition was carried out in a bath containing 15 g/l $ZnF_2.4H_2O$ (calculated as $ZnF_2$) at 25° C. for 5 minutes. The results are shown in Table 2.

TABLE 2

Sample Conditions, Pretreating Conditions vs. Zn Depositions (Zn g/m$^2$)

| Pretreatment | | Sample material: AA 1050 tube | AA 1050 plate | Brazing Sheet AA 4045/3003/4045 |
|---|---|---|---|---|
| Trichloroethylene vapor | | 2.4 | 4.0 | 2.5 |
| NaOH | (55° C., 0.5 min.) | 3.8 | 4.1 | 3.9 |

EXAMPLE 3

For comparison with the prior art, samples were prepared as in Example 1, pretreated in trichloroethylene, and then subjected to zinc deposition in a bath containing 350 g/l NaOH and 60 g/l ZnO. The results are shown in Table 3.

TABLE 3

| | Bath temperature (° C.) | Dipping Time (min) | Zn depositing amount (g/m$^2$) | Surface condition |
|---|---|---|---|---|
| Comparative experiment 1 | 20 | 25 | 12.2 | Adhering to finger tip by rubbing |
| Comparative experiment 2 | 45 | 2 | — | Abnormal deposition |

As may be seen from Table 3, abnormal deposition occurred at the higher bath temperature (45° C.) while at normal bath temperature (20° C.), more than 20 minutes were required to obtain deposition of more than 10 g/m$^2$ Zn and even at this lower temperature the bonding of Zn was not satisfactory.

It is to be understood that the invention is not limited to the procedures and embodiments hereinabove specifically set forth, but may be carried out in other ways without departure from its spirit.

I claim:

1. A process of treating an aluminum article having surfaces to increase the corrosion resistance thereof, comprising the steps of (a) dissolving solid zinc fluoride in water for establishing an aqueous bath containing dissolved zinc fluoride at a concentration between about 5 g/l and saturation, said bath having a pH of about 4 to about 6 and containing $Zn++$ ions at a concentration corresponding to the amount of zinc fluoride dissolved in the bath per unit volume of the bath, and (b) immersing the article in said bath for a time sufficient to deposit zinc on the article surfaces, said zinc fluoride being the source of the deposited zinc, and (c) heating the article for diffusing the deposited zinc into the surface-adjacent regions of the article.

2. A process according to claim 1, wherein undissolved excess zinc fluoride is present in suspension in said bath.

3. A process according to claim 1, wherein the immersing step is performed for a time sufficient to deposit zinc in an amount of about 2 to about 20 grams per square meter on the article surfaces.

4. A process according to claim 1, wherein said bath is at a temperature of about 20° to about 70° C. during performance of the immersing step.

* * * * *